US011028734B2

(12) United States Patent
Spadacini

(10) Patent No.: US 11,028,734 B2
(45) Date of Patent: Jun. 8, 2021

(54) RANKINE CYCLE PLANT AND PROCESS FOR THE REGASIFICATION OF LIQUEFIED GAS

(71) Applicant: EXERGY S.P.A., Bologna (IT)

(72) Inventor: Claudio Spadacini, Verbania (IT)

(73) Assignee: EXERGY INTERNATIONAL S.R.L., Olgiate Olona (IT)

( * ) Notice: Subject to any disclaimer, the term of this patent is extended or adjusted under 35 U.S.C. 154(b) by 0 days.

(21) Appl. No.: 16/625,886

(22) PCT Filed: Jun. 22, 2018

(86) PCT No.: PCT/IB2018/054617
§ 371 (c)(1),
(2) Date: Dec. 23, 2019

(87) PCT Pub. No.: WO2018/235043
PCT Pub. Date: Dec. 27, 2018

(65) Prior Publication Data

US 2020/0149434 A1 May 14, 2020

(30) Foreign Application Priority Data

Jun. 23, 2017 (IT) ..... 102017000070318

(51) Int. Cl.
*F01K 11/02* (2006.01)
*F01K 25/10* (2006.01)

(52) U.S. Cl.
CPC ..... *F01K 11/02* (2013.01); *F01K 25/10* (2013.01)

(58) Field of Classification Search
CPC ..... F01K 11/02; F01K 25/10
(Continued)

(56) References Cited

U.S. PATENT DOCUMENTS 4,573,321 A * 3/1986 Knaebel ..... F01K 25/065 60/649
2003/0167769 A1* 9/2003 Bharathan ..... F01K 25/065 60/676

(Continued)

FOREIGN PATENT DOCUMENTS

CN 103 362 579 A 10/2013
WO 2006/111957 A2 10/2006
WO 2013/171685 A1 11/2013

OTHER PUBLICATIONS

Oct. 1, 2018 Search Report issued in International Patent Application No. PCT/IB2018/054617.

(Continued)

*Primary Examiner* — Hoang M Nguyen
(74) *Attorney, Agent, or Firm* — Oliff PLC

(57) ABSTRACT

A Rankine cycle plant for the regasification of liquefied gas, includes: a Rankine closed loop system; a source of liquefied gas at a cryogenic temperature operatively coupled to a condenser to receive heat from a working fluid from an expansion turbine to take the liquefied gas to the gaseous state; a source of a heating fluid at a temperature higher than the cryogenic temperature operatively coupled to an evaporator to transfer heat to the working fluid coming from the condenser. The expansion turbine is radial centrifugal with at least one auxiliary outlet interposed between successive stages. The condenser is multilevel and has at least two condensing chambers, wherein a lower chamber being connected to an outflow opening of the expansion turbine and an upper chamber connected to the auxiliary outlet of the expansion turbine.

20 Claims, 5 Drawing Sheets

(58) Field of Classification Search
USPC ..... 60/651, 653, 671, 685
See application file for complete search history.

(56) References Cited

U.S. PATENT DOCUMENTS

| | | | | |
|---|---|---|---|---|
| 2009/0100845 | A1 | 4/2009 | Amir et al. | |
| 2010/0146971 | A1 | 6/2010 | Mak | |
| 2010/0205979 | A1* | 8/2010 | Gentry | F17C 9/04 62/50.3 |
| 2013/0160486 | A1 | 6/2013 | Amir et al. | |
| 2018/0353873 | A1* | 12/2018 | Goldshtein | F01K 9/003 |

OTHER PUBLICATIONS

Oct. 1, 2018 Written Opinion issued in International Patent Application No. PCT/IB2018/054617.

* cited by examiner

RANKINE CYCLE PLANT AND PROCESS FOR THE REGASIFICATION OF LIQUEFIED GAS

FIELD OF THE INVENTION

The present invention regards a Rankine plant and a Rankine cycle process for the regasification of liquefied gas. In particular, the present invention regards a plant and a process that exploit a closed Rankine cycle that extracts heat from a heat source and discharges the heat through one or more condensing stages in a liquefied gas flow in the regasification and heating stage. For example, the present invention is applicable to the regasification of liquefied natural gas or in air fractionation plants that implement a cryogenic distillation process.

BACKGROUND OF THE INVENTION

Systems for the regasification of liquefied natural gas (LNG), which use the organic Rankine cycle (ORC) for this purpose, are known.

For example, public documents U.S.2013160486, WO2006111957, U.S.2009100845 each illustrate a system for the regasification and production of power from liquid natural gas (LNG). The system comprises a closed circuit of the ORC (Organic Rankine Cycle) type operatively coupled to a source of heat (seawater or equivalent source) in an evaporator and to the liquid natural gas (LNG) in one or more condensers. The organic fluid in the ORC cycle is vaporised in the evaporator, sent to an expansion turbine where it is expanded generating power and then to the condenser/s where the organic fluid transfers heat to the liquid natural gas which is thus regasified. Such embodiments of such documents comprise a first and a second condenser. The organic working fluid flowing out from the turbine is sent to the first condenser and a portion of the same organic fluid drawn from the turbine at an intermediate pressure is sent to the second condenser.

The public document WO 2013/171685, on behalf of the Applicant, illustrating an ORC system for production of power through an Organic Rankine Cycle is also known. Such ORC system comprises a turbine of the radial centrifugal type formed by a single rotor disc and provided with an auxiliary opening. Such auxiliary opening is interposed between an inflow opening and an outflow opening of the turbine and it is in fluid connection with an auxiliary circuit, to extract from the turbine or introduce into the turbine the organic working fluid at an intermediate pressure between an inflow pressure and an outflow pressure.

SUMMARY

In this context, the Applicant observed that the regasification systems of the known type that exploit ORC circuits, especially those with intermediate bleeding operations, are structurally extremely complex and thus expensive and cumbersome. For example, the systems illustrated in the aforementioned documents U.S.2013160486, WO2006111957, U.S.2009100845 have several condensers and an equivalent number of pumps and/or several turbo-expanders, for example as shown in document U.S.2010014697.

In this context, the Applicant perceived the need to provide a Rankine plant and a Rankine cycle process for the regasification of liquefied gas provided with a configuration that is simple and relatively non-cumbersome.

In particular, the applicant perceived the need to provide a plant and a process comprising a limited number of components.

The Applicant also perceived the need to provide a plant and a process whose single components are structurally simple and compact.

Thus, the Applicant found that the aforementioned objectives and other objectives can be achieved by adopting—in the ORC closed circuit—an expansion turbine of the radial centrifugal type (outflow), preferably with one or more intermediate bleeding operations and/or a multilevel condenser.

In particular, these and other objects are substantially attained by a Rankine plant and a Rankine cycle process for the regasification of liquefied gas of the type claimed in the attached drawings and/or described in the following aspects.

In an aspect, the present invention regards a Rankine cycle plant for the regasification of liquefied gas, comprising:

- a Rankine closed loop system comprising at least:
  - one evaporator;
  - an expansion turbine provided with an inflow opening, an outflow opening;
  - a generator operatively connected to the expansion turbine;
  - a condenser;
  - a pump;
  - conduits configured to connect the evaporator, the expansion turbine, the condenser and the pump according to a closed cycle in which a working fluid circulates;
- a source of liquefied gas at a cryogenic temperature, wherein the source of liquefied gas is operatively coupled to the condenser to receive heat from the working fluid flowing out from the expansion turbine so as to take the liquefied gas to the gaseous state;
- a source of a heating fluid at a higher temperature than the cryogenic temperature, wherein the source of heating fluid is operatively coupled to the evaporator to transfer heat to the working fluid coming from the condenser.

The objectives described above and others are also substantially attained by a Rankine cycle process for the regasification of a liquefied gas, comprising:

- circulating a working fluid according to Rankine closed cycle for vaporising the working fluid, expanding the working fluid after vaporisation, condensing the working fluid after expansion and then vaporising it once again;
- wherein vaporising the working fluid comprises transferring heat from a heating fluid to the heating fluid;
- wherein condensing the working fluid comprises transferring heat from the working fluid to a liquefied gas at a cryogenic temperature until said gas is regasified.

In an aspect, the plant and/or the process are applied to the regasification of liquefied natural gas.

In an aspect, the plant and/or the process are applied to the fractionation of air by means of cryogenic distillation.

In an aspect, it is provided to extract—from the expansion turbine—working fluid at at least one intermediate pressure.

In an aspect, the expansion turbine comprises at least one auxiliary outlet (intermediate pressure bleeding).

In an aspect, the expansion of the fluid is obtained in a radial centrifugal expansion turbine (outflow).

In an aspect, the expansion turbine is radial centrifugal (outflow), preferably of the multi-stage type.

In an aspect, said at least one auxiliary outlet is interposed between successive stages of said turbine of the radial centrifugal expansion turbine.

The radial centrifugal turbine enables having a high number of stages per single rotor disc, with higher efficiency with respect to a single-stage turbine, like it typically occurs in centripetal turbines, or with two or three stages like it occurs in axial turbines. In particular, the multi-stage radial centrifugal turbine enables obtaining the space between the stages for extracting the vaporised working fluid at successively decreasing pressure levels, thus enabling obtaining smaller average distance between the condensation curve and evaporation/heating curve of the liquefied gas on the T-q diagram and thus lesser generation of non-reversibility and greater efficiency.

This distinctive aspect of the radial centrifugal turbine enables operating with a multilevel cycle with a simple configuration (single turbine, single disc), instead of using cantilevered turbines in series and/or in parallel or turbines arranged between bearings (i.e. not cantilevered) and with intermediate extraction.

Furthermore, the radial centrifugal turbine in cryogenic configuration (which operates at low temperatures, i.e. for example between −120° C. and −70° C., more typically between −80° C. and −60° C., like in the plant of the present invention), irrespective of the multilevel configuration, has the unique characteristic of having non-cryogenic working temperature at the centre of the machine, given that the first stages are arranged in a central position on the rotor disc, near the inflow opening and the shaft. In this manner, the entire mechanical part of the machine (mechanical sealing, bearings, supports, etc.) operates at a non-cryogenic temperature, while the cryogenic part remains in the outer part of the rotor disc, where the most prestigious material can be used for the construction of the stages, and in the housing.

In an aspect, condensation is obtained by a multilevel condenser comprising at least two condensing chambers.

In an aspect, condenser is multilevel condenser and it comprises at least two condensing chambers.

In an aspect, a lower chamber of said at least two condensing chambers is connected to the outflow opening of the expansion turbine and an upper chamber of said at least two condensing chambers is connected to said at least one auxiliary outlet of the expansion turbine. Thus, the condenser is compact too.

Thus, the plant according to the present invention may provide for the presence of the radial centrifugal expansion turbine (with any type of condenser) or multilevel condenser (with any type of turbine) or both.

In an aspect according to the preceding aspects, the expansion turbine comprises a single rotor disc and a plurality of stages arranged radially one after the other at a front face of the rotor disc.

In an aspect, the expansion turbine comprises a fixed housing, wherein the rotor disc is rotatably inserted into the fixed housing.

In an aspect, the auxiliary outlet is obtained in a front wall of the fixed housing.

In an aspect, the auxiliary outlet is obtained in a lateral wall of the fixed housing, preferably in a wall that connects the front wall to a rear wall.

In an aspect, the front face of the single rotor disc carries a plurality of annular series of rotor blades. Each annular series comprises a plurality of rotor blades arranged along a circular path coaxial to a rotation axis of the expansion turbine. Between successive annular series of rotor blades, annular series of stator blades are arranged, integrally joined to a front wall of the fixed housing facing the rotor disc. Pairs of annular series of rotor and stator blades form stages of the radial centrifugal expansion turbine.

In an aspect, the inflow opening of the radial centrifugal expansion turbine is arranged at a radially central area of the rotor disc.

In an aspect, the outflow opening of the radial centrifugal expansion turbine is arranged at a radially peripheral edge of the rotor disc.

In an aspect, the auxiliary outlet of the radial centrifugal expansion turbine opens between two of said stages.

In an aspect, the radial centrifugal expansion turbine comprises a plurality of auxiliary outlets each interposed between successive stages. From said auxiliary outlets working fluid is drawn at progressively decreasing pressure starting from the auxiliary outlet closest to the rotation axis and progressively moving away radially.

In an aspect, the two stages between which the auxiliary outlet opens, are radially spaced to define a chamber for extracting the working fluid.

In an aspect, the stages of the radial centrifugal expansion turbine delimit between each other a plurality of extraction chambers, each associated to a respective auxiliary outlet.

In an aspect, the multilevel condenser comprises a casing delimiting therein at least two condensing chambers and an outflow duct connecting the upper chamber to the lower chamber.

In an aspect, the multilevel condenser comprises a plurality of condensing chambers arranged one over the other and a plurality of ducts connecting said condensing chambers to each other in a cascade fashion. The working fluid that condenses in each chamber, accumulates in liquid form in a bottom of said chamber and flows from here through the respective outflow duct into the lower chamber up to the bottom of the chamber arranged further lower and connected to the evaporator.

In an aspect, the condensing chamber arranged further lower is connected to the discharge of the turbine.

In an aspect, rising upwards with respect to the condenser, successive chambers are connected to auxiliary outlets of the expansion turbine at increasing pressure.

In an aspect, the pressure of the working fluid in each condensing chamber grows flowing from one chamber to the one arranged further above.

In an aspect, the casing of the multilevel condenser has an elongated shape.

In an aspect, the casing of the multilevel condenser has a series of inner septa that partition it internally into the aforementioned chambers.

In an aspect, the casing of the multilevel condenser has a mainly vertical extension.

In an aspect, the casing of the multilevel condenser has a mainly oblique extension.

In an aspect, the casing of the multilevel condenser has a mainly horizontal extension.

In an aspect, the condenser comprises at least one tube or tube bundle connected to the source of liquefied gas.

In an aspect, said at least one tube or tube bundle passes through, preferably vertically, said at least two condensing chambers, preferably a plurality of condensing chambers.

In an aspect, the liquefied gas flows from the bottom upwards in said at least one tube or tube bundle.

In an aspect, said at least one tube or tube bundle enters into a lower portion of the casing of the condenser and flows out from an upper portion of said casing of the condenser.

Thus, the cooler liquefied gas flows first through the condensing chamber arranged further below and at lower pressure and temperature (of the working fluid), and then in succession through the condensing chambers at progressively increasing pressure and temperature, thus being heated and gasified.

In an aspect, the pump is only one and it is operatively arranged between the lower chamber of the condenser and the evaporator for pumping the condensed working fluid up to said evaporator. The structure of the condenser according to the invention enables using a single pump and thus simplifying the plant further.

In an aspect, the conduits comprise a conduit which connects the lower chamber of the condenser and the evaporator.

In an aspect, the pump is operative on said conduit.

In an aspect, a section of said conduit passes through one or more chambers of the condenser, to recover heat from the working fluid present in the condenser and transfer said heat to the working fluid flowing into the evaporator.

In an aspect, said section of the conduit has the shape of at least one exchange pack.

In an aspect, said section passes through at least one condensing chamber arranged above the condensing chamber arranged further downwards.

In an aspect, the plant comprises a first and a second expansion turbine.

In an aspect, said generator is coupled both to the first and to the second expansion turbine.

In an aspect, at least one of said first and second expansion turbine is radial centrifugal.

In an aspect, at least one of said first and second expansion turbine comprises at least one auxiliary outlet (bleeding at intermediate pressure) operatively connected to the condenser.

In an aspect, an outflow opening of the first expansion turbine is connected to an inflow opening of the second expansion turbine.

In an aspect, the plant comprises a heat exchanger arranged between the outflow opening of the first expansion turbine and the inflow opening of the second expansion turbine.

In an aspect, the heat exchanger is operatively coupled to the source of heating fluid.

In an aspect, the first expansion turbine is a high pressure turbine and said at least one respective auxiliary outlet is operatively connected to a respective upper chamber of the condenser.

In an aspect, the second expansion turbine is a low pressure turbine and said at least one respective auxiliary outlet is operatively connected to a respective lower chamber of the condenser.

In an aspect, the working fluid is or comprises an organic fluid, preferably a refrigerant gas, preferably HFC, more preferably HFC-113.

In an aspect, the working fluid is or comprises a hydrocarbon, preferably ethane.

In an aspect, the working fluid is selected from the group comprising: $CO_2$, $N_2O$.

In an aspect, the Rankine closed cycle is of the organic type (ORC—Organic Rankine Cycle).

In an aspect, the heating fluid is water, preferably seawater. Normally, the liquefied natural gas regasification plants are at the sea shores given that liquefied natural gas is transported as it is by ships. Thus, seawater is an indispensable resource. Liquefied natural gas is unloaded from the ships and stored, at cryogenic temperature and at atmospheric pressure, in special tanks. It is then sent to the regasification plant where it is reconverted into gaseous state. At the end of the regasification process, which determines a natural expansion of the volume thereof, the gas is for example conveyed in the national gas supply system through a gas pipeline.

In an aspect, the heating fluid, preferably water, comes from the condenser of a vapour turbine.

In an aspect, the heating fluid is a fluid of a cooling process.

In an aspect, the heating fluid flowing into the evaporator has a temperature comprised between 5° C. and 70° C., preferably between 5° C. and 30° C., preferably between 10° C. and 20° C., preferably equivalent to 15° C.

In an aspect, the liquefied gas flowing into the condenser has a temperature comprised between −155C° and −173C.°, for example of −160° C.

It is emphasised that the plant of the present invention may comprise the expansion chamber of the radial centrifugal type (outflow) as defined in one or more of the preceding aspects and/or the condenser of the multilevel type as defined in one or more of the preceding aspects.

Further characteristics and advantages will be more apparent from the detailed description of embodiments of a Rankine cycle plant for the regasification of liquefied gas according to the present invention.

DESCRIPTION OF THE DRAWINGS

Such description will be outlined hereinafter with reference to the attached drawings, provided solely for by way of non-limiting example, wherein.

DETAILED DESCRIPTION

With reference to the attached figures, a Rankine cycle plant for the regasification of liquefied gas LG, for example liquefied natural gas is indicated in its entirety with reference number 1. In a different embodiment not illustrated, the plant could be a plant for the fractionation of air through cryogenic distillation.

Figure 1:
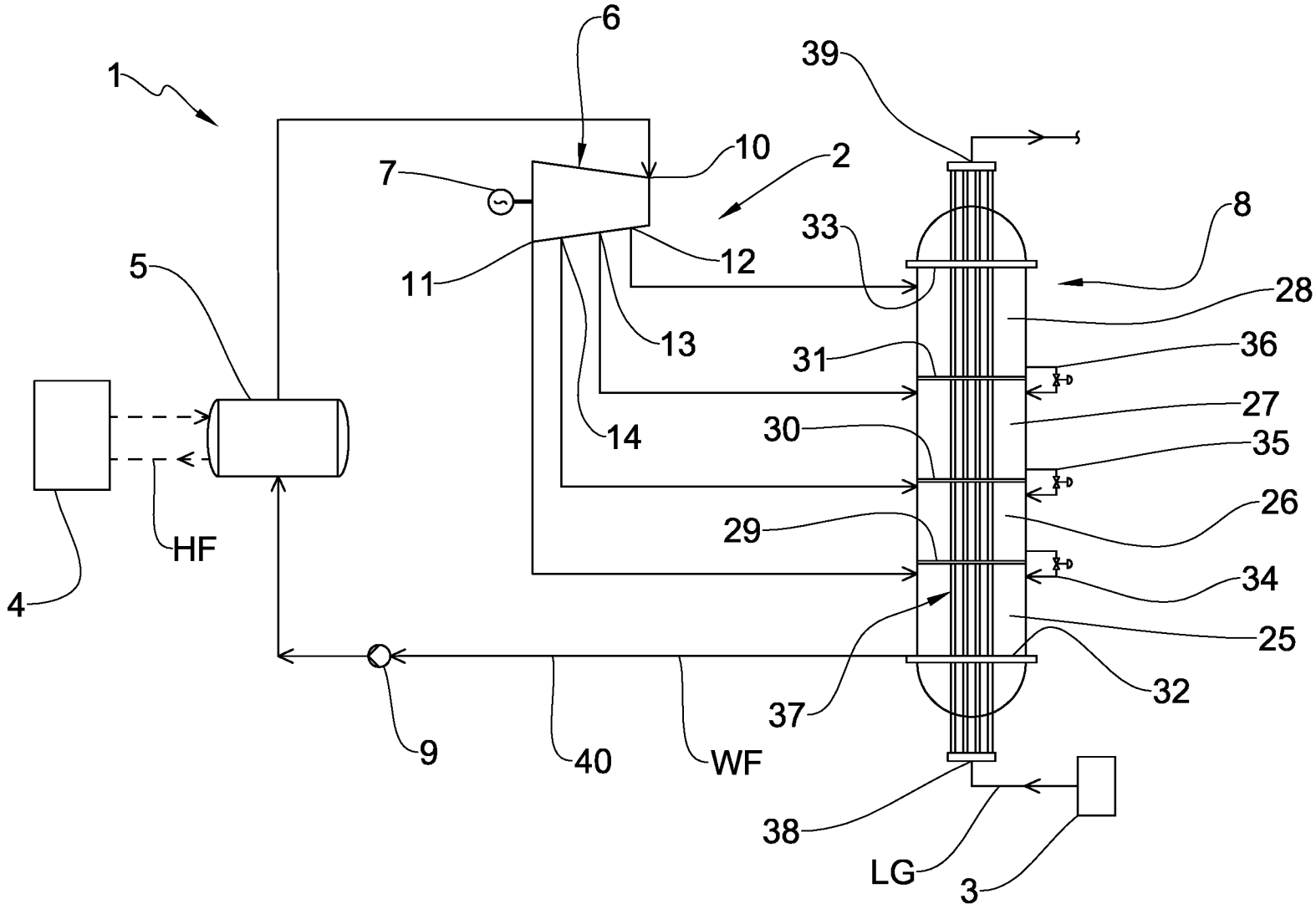
FIG. 1 illustrates a Rankine cycle plant for the regasification of liquefied gas according to the present invention.

The plant 1 comprises a Rankine closed cycle system 2, a source 3 of liquefied gas LG (schematically represented in FIG. 1) and a source 4 of a heating fluid HF (schematically represented in FIG. 1).

The source of liquefied gas LG is for example a tank in which the liquefied natural gas LG stored at the cryogenic temperature "$T_{lg}$" (for example at −160° C.) and at atmospheric pressure. The source 4 of a heating fluid HF is the sea and the heating fluid HF is thus water directly drawn from the sea, for example at the temperature "$T_{hf}$" of 15° C. The heating fluid could also be water coming from the condenser of a vapour turbine or a fluid of another process under cooling.

The Rankine closed cycle system 2 uses a working WF which, for example, is an organic fluid (the cycle is thus an ORC—Organic Rankine Cycle), for example a refrigerant gas, for example an HFC, such as HFC-113. In other embodiments, the working fluid can also be a hydrocarbon, for example ethane, or $CO_2$, $N_2O$. The closed cycle ORC 2 comprises: an evaporator 5, an expansion turbine 6, a generator 7 operatively connected to the expansion turbine 6, a condenser 8, a pump 9. Conduits connect, according to a closed cycle, the evaporator 5, the expansion turbine 6, the condenser 8, the pump 9. The working fluid WF is circulated in the closed cycle. The working fluid WF is heated and vaporised in the evaporator 5. The working fluid WF in vapour state flowing out from the operator 5 flows into the expansion turbine 6 where it expands, causing the rotation of the rotor/s of the expansion turbine 6 and the generator 7 which thus generates electric power. The expanded working fluid WF subsequently enters into the condenser 8 where it is brought back to the liquid state and herein pumped 9 into the evaporator 5 once again.

The source 3 of liquefied natural gas LG is operatively coupled to the condenser 8 to receive heat from the working fluid WF flowing out from the expansion turbine 6 so as to take the liquefied natural gas LG to the gaseous state. Thus, the condensing of the working fluid WF in the condenser 8 occurs by transferring heat to the liquid natural gas LG.

The source 4 of the heating fluid (seawater) is operatively coupled to the evaporator 5 to transfer heat to the working fluid WF coming from the condenser 8. Thus, the heating and vaporisation of the working fluid WF occur in the evaporator 5 for absorbing heat from the seawater.

As observable from FIG. 1, the expansion turbine 6 is provided with an inflow opening 10, an outflow opening 11 and a first, a second and a third auxiliary outlet 12, 13, 14 at intermediate pressure (intermediate with respect to an inflow pressure and an outflow pressure).

Figure 5:
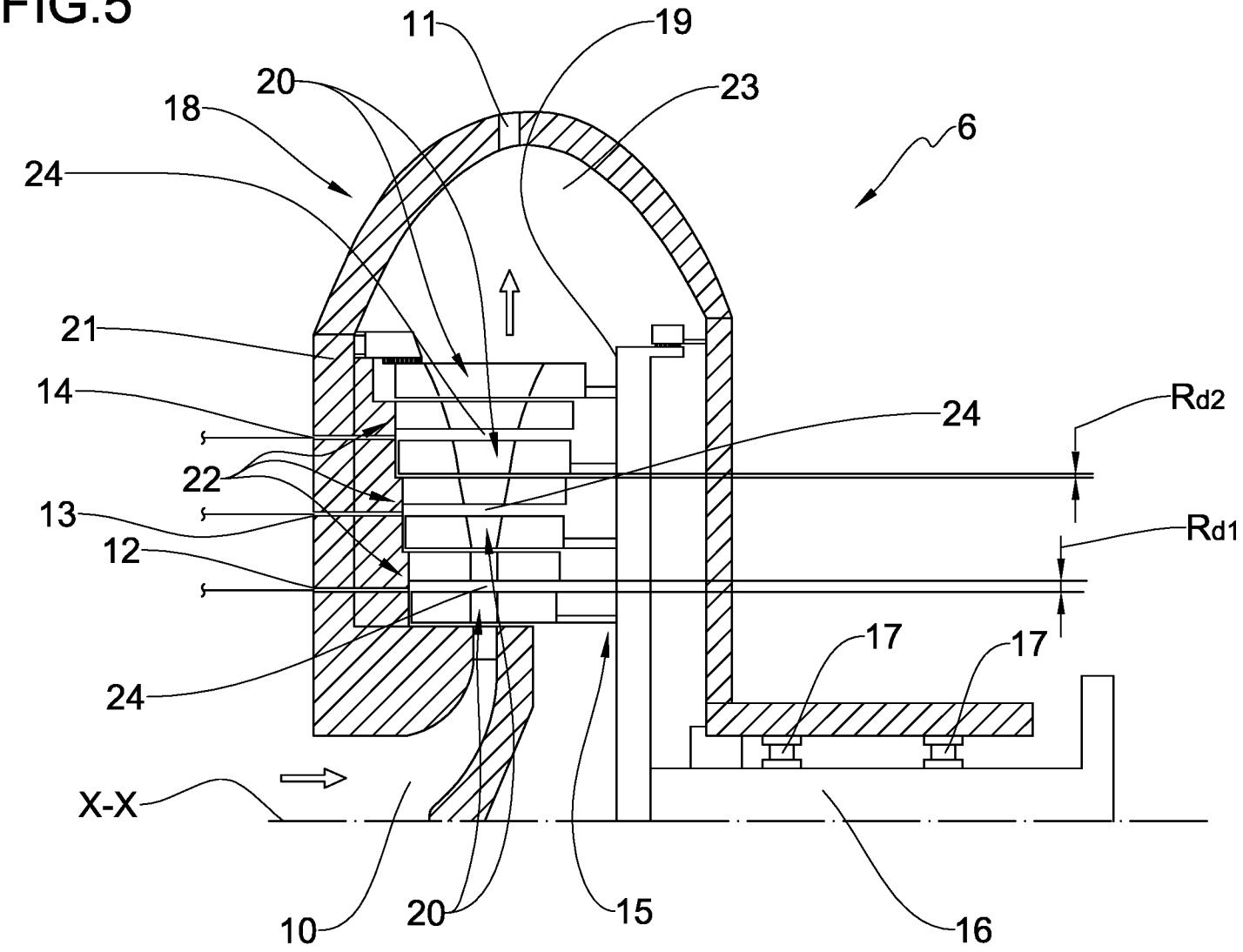
FIG. 5 illustrates a radial semi-section of an expansion turbine implemented/implementable in the plants according to the preceding figures.

The expansion turbine 6 of the plant of FIG. 1 is preferably radial centrifugal, of the type illustrated in FIG. 5, and it comprises a single rotor disc 15 integrally joined with a shaft 16 which is rotatably supported, for example by means of bearings 17, in a sleeve of a fixed housing 18.

A front face 19 of the rotor disc 15 carries a plurality of annular series of rotor blades 20. Each annular series comprises a plurality of rotor blades 20 arranged along a circular path coaxial to a rotation axis X-X of the expansion turbine 6. A front wall 21 of the fixed housing 18 facing the rotor disc 15 carries an annular series of stator blades 22. Each of the annular series of stator blades 22 is radially arranged between two annular series of rotor blades 20. Each pair formed by an annular series of stator blades 22 and an annular series of rotor blades 20 defines a radial stage of the radial centrifugal expansion turbine 6. The rotor blades 20 and the stator blades 22 extend mainly along axial directions and have attachment angles radially faced towards the rotation axis X-X.

FIG. 5 further illustrates that the inflow opening 10 is axial and it is arranged at a centre of the rotor disc 15, i.e. at the rotation axis X-X. The outflow opening 11 was schematically illustrated in FIG. 5 and it is connected to an annular chamber 23 arranged around a radially peripheral edge of the rotor disc "D" and in a radially external position with respect to the radial stages. The annular chamber 23 is delimited by a lateral wall of the fixed housing 18 arranged around the rotor disc 15. A rear wall (with respect to the front face 19 of the rotor disc 15) connects the sleeve to the lateral wall.

The first, second and third auxiliary outlet 12, 13, 14 are obtained through the front wall 21 of the fixed housing 18 and each auxiliary opening opens in the fixed housing 18 between two radial stages. In other embodiments, not illustrated, the auxiliary outlets can be obtained through lateral walls of the fixed housing. The radial centrifugal expansion turbine 6 comprises a plurality of auxiliary outlets 12, 13, 14, each of which is interposed between successive stages. The illustrated turbine 6 has four stages. The first auxiliary outlet 12 is arranged between the first and the second stage. The second auxiliary outlet 13 is arranged between the second and the third stage. The third auxiliary outlet 14 is arranged between the third and the fourth stage.

From said auxiliary outlets 12, 13, 14, the working fluid WF is drawn at progressively decreasing pressure starting from the first auxiliary outlet 12 closest to the rotation axis X-X. In other words, the outlet pressure of the working WF from the first auxiliary outlet 12 is higher than the outflow pressure of the second auxiliary outlet 13 which is higher than the outflow pressure of the third auxiliary outlet 14 which is in turn higher than the pressure at the outflow opening 11. In the illustrated embodiment, the extraction chambers 24 are thus three. Furthermore, a radial distance between one stage and the subsequent one is such to delimit a sort of chamber 24 for the extraction of the working fluid WF in fluid communication with the respective auxiliary outlet 12, 13, 14. For example, a radial distance $R_{d1}$ at an extraction chamber 24 is from five to ten times higher than a radial distance $R_{d2}$ between the stages where the chamber 24 is not present (FIG. 5).

In the preferred embodiment illustrated in FIG. 5, the condenser 8 is multilevel and it comprises four condensing chambers 25, 26, 27, 28. The multilevel condenser 8 comprises a substantially cylindrical casing having an elongated shape and a vertically oriented main axis. In other embodiments not illustrated, the casing of the multilevel condenser may have a main oblique or horizontal extension.

Inside the illustrated substantially cylindrical casing, three horizontal septa 29, 30, are arranged which partition the internal volume thereof into the aforementioned four condensing chambers 25, 26, 27, 28. A first chamber 25 is delimited between a base 32 and a first septum 29; a second chamber 26 is delimited between the first septum 29 and a second septum 30; a third chamber 27 is delimited between the second septum 30 and a third septum 31; a fourth chamber 28 is delimited between the third septum 31 and a roof 33 of the casing. The second chamber 26 is arranged above the first 25, the third chamber 27 is arranged above the second 26 and the fourth chamber 28 is arranged above the third 27.

Discharge ducts 34, 35, 36, possibly provided with respective valves, mutually connect the aforementioned condensing chambers 25, 26, 27, 28. A first discharge duct 34 connects the second chamber 26 to the first chamber 25. A second duct 35 connects the third chamber 27 to the second chamber 26. A third discharge duct 36 connects the fourth chamber 28 to the third chamber 27.

The first chamber 25, arranged further lower, is connected to the outflow opening 11 of the expansion turbine 6 to receive the working fluid WF flowing out from said outflow opening 11. The second chamber 26 is connected to the third auxiliary opening 14 to receive the working fluid WF flowing out from said third auxiliary opening 14. The third chamber 27 is connected to the second auxiliary opening 13 to receive the working fluid WF flowing out from said second auxiliary opening 14. The fourth chamber 28 is connected to the first auxiliary opening 12 to receive the working fluid WF flowing out from said first auxiliary opening 12. Furthermore, the first chamber 25, arranged further lower, is connected to the pump 9 and to the evaporator 5 to send, through said single pump 9, the condensed working fluid WF to said evaporator 5.

The working fluid WF that condenses in each chamber 25, 26, 27, 28, accumulates in liquid form on the bottom of said chamber 25, 26, 27, 28 and flows from here through the respective outflow duct 34, 35, 36 into the lower chamber up to the bottom of the first chamber 25 arranged further lower and connected to the evaporator 5.

The condenser 8 further comprises a tube bundle 37 connected to the source of liquefied gas 3. The tube bundle 37 develops vertically into the casing of the condenser 8 and passes through the septa 29, 30, 31 and each chamber 25, 26, 27, 28. The tube bundle 37 has a lower end 38 projecting from a lower portion of the casing of the condenser 8 and connected/connectible to the source of liquefied gas 3. The tube bundle 37 has an upper end 39 projecting from an upper portion of the casing of the condenser 8 and connected/connectible for example to an appliance or a methane gas pipeline. The liquefied natural gas coming from the source 3 flows from the bottom upwards in the tube bundle 37 and thus firstly flows through the first condensing chamber 25, arranged further below and at lower pressure and temperature (of the working fluid), and then in succession through the second, third and fourth condensing chambers 26, 27, 28 at progressively increasing pressure and temperature, thus being heated and gasified.

By way of example and according to the process or the present invention, the liquefied natural gas LG flows into the condenser 8 from the bottom in liquid form and at a temperature of −160° C. and it flows out in gaseous state from the top at a temperature of −50° C.

The working WF of the closed Rankine cycle flowing out—in form of vapour—from the expansion turbine 6 flows into the condensing chambers at the conditions indicated in the following Table 1.

TABLE 1

| | T (° C.) | P (bars) |
|---|---|---|
| First auxiliary outlet 12 and fourth chamber 28 | −25 | 9.2 |
| Second auxiliary outlet 13 and third chamber 27 | −50 | 3.4 |
| Third auxiliary outlet 14 and second chamber 26 | −75 | 1.2 |
| Outflow opening 11 and first chamber 25 | −90 | 0.5 |

The working fluid WF flows out in liquid state (at a temperature of −90° C.) from the first chamber 25 through a conduit 40 which connects the condenser 8 with the evaporator 5 and on which the pump 9 is operative.

In the evaporator 5, the seawater 15° C., which flows through said evaporator 5, transfers heat to the working fluid WF thus vaporising it and heating it up to a temperature of 15° C.

The vaporised working fluid WF flows into the expansion turbine 6 where it expands thus starting a new cycle.

Figure 2:
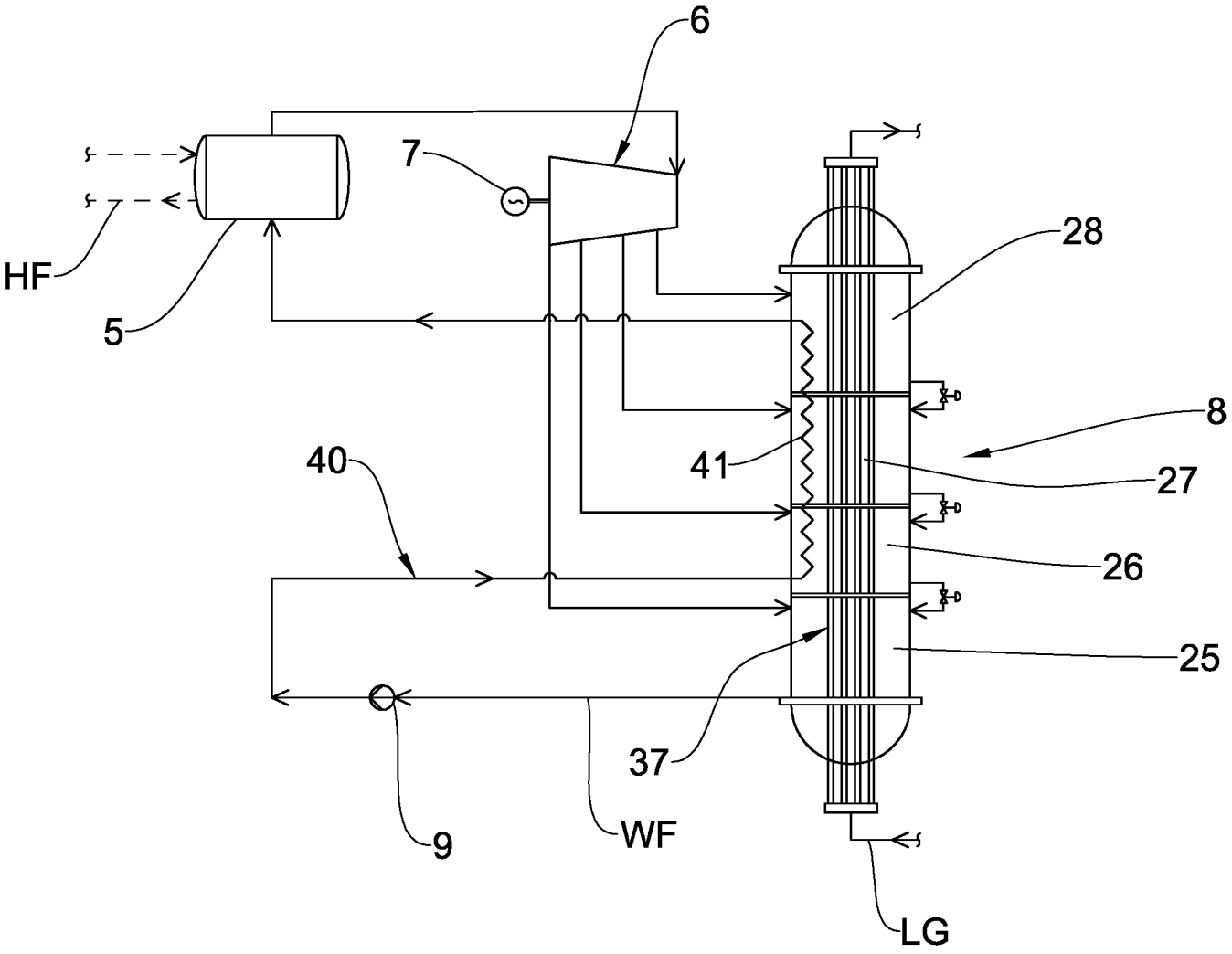
FIG. 2 illustrates a variant of the plant of FIG. 1.

The variant embodiment of FIG. 2 differs from that of FIG. 1, only due to the fact that a section 41 of the aforementioned conduit 40, passes through one or more chambers of the condenser 8, to recover heat from the working fluid WF present in the condenser 8 and transfer said heat to the working fluid flowing into the evaporator 5. In particular, said section 41 coming from the pump 9 flows into the second chamber 26 and passes through the second, the third and the fourth chamber 26, 27, 28 before reaching the evaporator 5. In the illustrated embodiment, said section 41 is schematically represented as a piping but it could also comprise one or more exchange packs.

Figure 3:
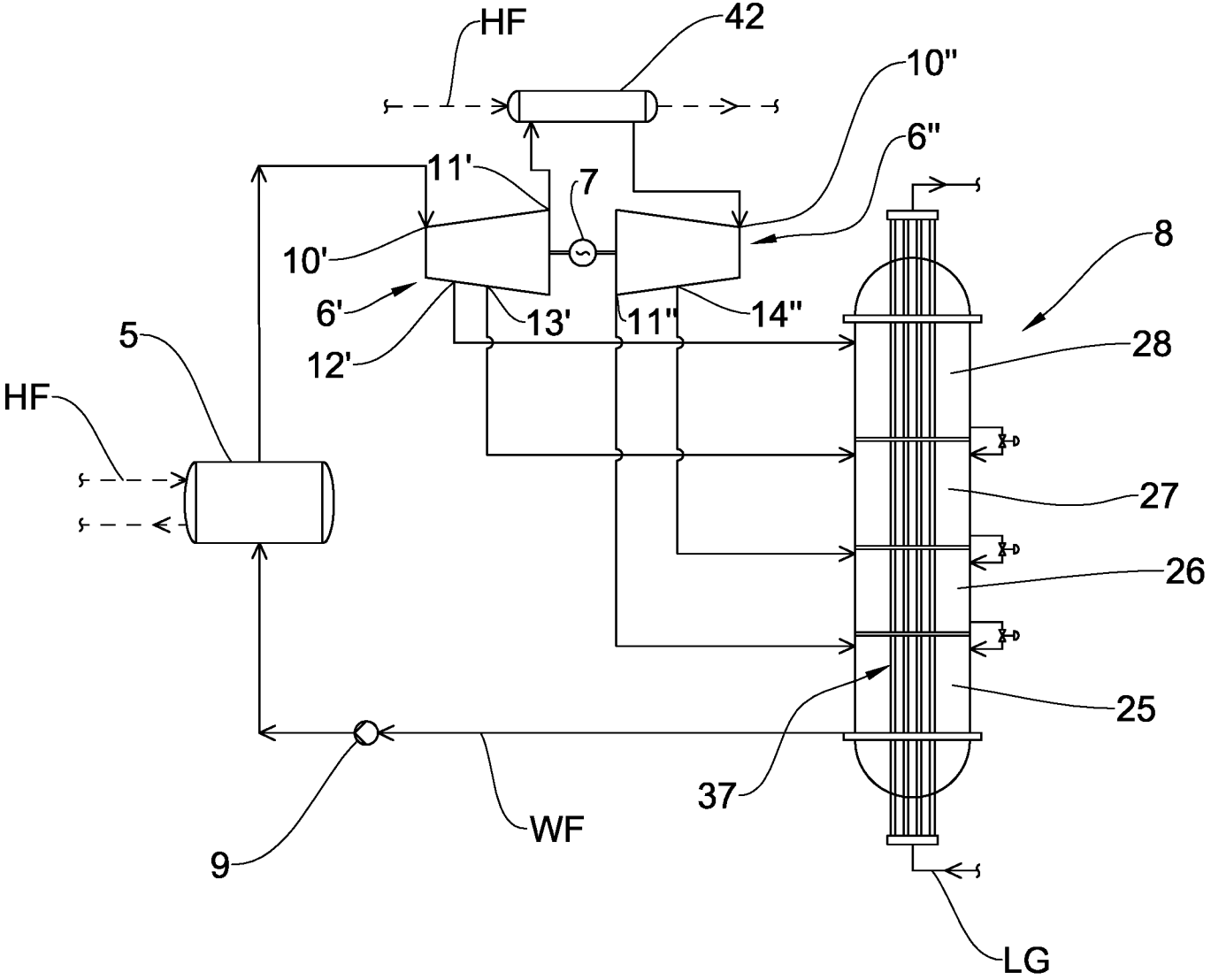
FIG. 3 illustrates a different embodiment of the plant of FIG. 1.

The embodiment of FIG. 3 differs from that of FIG. 1 due to the fact that, instead of a single expansion turbine 6, a first expansion turbine 6' (high pressure) and a second expansion turbine 6" (low pressure) are present, connected in series by interposing a heat exchanger 42 (as concerns the working fluid that flows through it). Furthermore, the first and the second expansion turbine 6', 6" are mechanically connected to a single generator 7.

The first expansion turbine 6' has an inflow opening 10', directly connected to the evaporator 5 or receive the working fluid WF to be expanded, and an outflow opening 11' connected to the heat exchanger 42 and then to an inflow opening 10" of the second expansion turbine 6". Through the heat exchanger 42 there flows through the heating fluid HF, for example seawater, which transfers heat to the working fluid WF in the state of partly expanded vapour in the first turbine 6' before flowing into the second turbine 6".

Furthermore, the first expansion turbine 6' has a first auxiliary opening 12' connected to the fourth condensing chamber 28 and a second auxiliary opening 13' (at lower pressure with respect to the first auxiliary opening 12') connected to the third condensing chamber 27.

Furthermore, the second expansion turbine 6" has a third auxiliary opening 14" connected to the second condensing chamber 26 and an outflow opening 11" (at lower pressure with respect to the third auxiliary opening 14") connected to the first condensing chamber 25.

Preferably, one or both of the aforementioned first expansion turbine 6' (high pressure) and second expansion turbine 6" (low pressure) is/are of the radial centrifugal type (i.e., similar to the one illustrated in FIG. 5).

Figure 4:
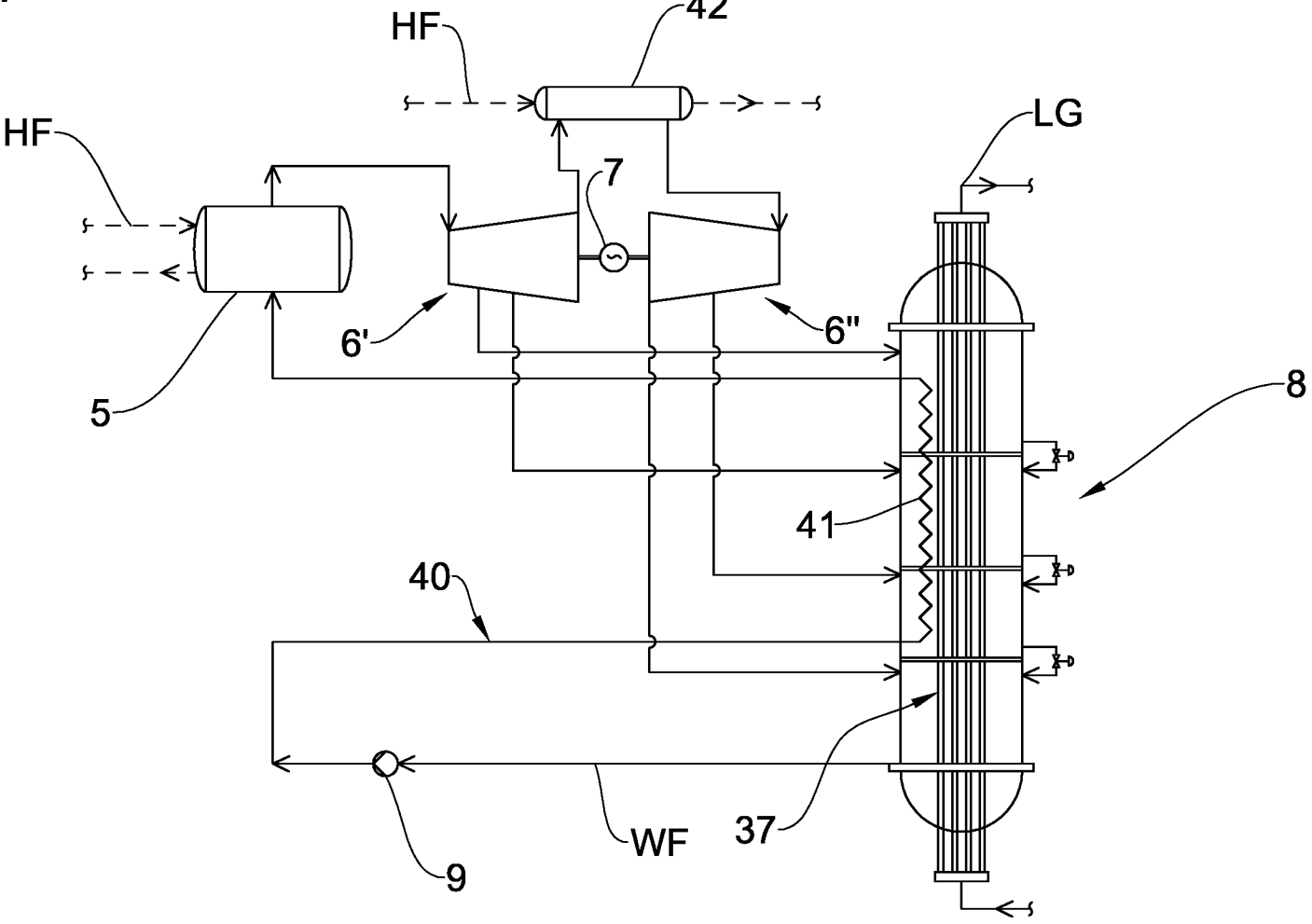
FIG. 4 illustrates a variant of the plant of FIG. 3.

The variant embodiment of FIG. 4 differs from that of FIG. 3 due to the fact that a section 41 of the aforementioned conduit 40 passes through one or more condensing chambers 8, like in FIG. 2.

ELEMENTS LIST

1 Rankine cycle plant for the regasification of liquefied gas
2 Rankine closed loop system
3 Source of liquefied gas
4 Source of heating fluid
5 Evaporator
6 6', 6" Expansion turbine
7 Generator
8 Condenser
9 Pump
10 10', 10" Inflow opening
11 11', 11" Outflow opening
12 12' First auxiliary outlet
13 13' Second auxiliary outlet
14 14" Third auxiliary outlet
15 Rotor disc
16 Shaft
17 Bearings
18 Fixed housing
19 Front face
20 Rotor blades
21 Front wall
22 Stator blades
23 Annular chamber
24 Extraction chamber
25 First condensing chamber
26 Second condensing chamber
27 Third condensing chamber
28 Fourth condensing chamber
29 First septum
30 Second septum
31 Third septum
32 Base
33 Roof

34 First discharge duct
35 Second discharge duct
36 Third discharge duct
37 Tube bundle
38 Lower end
39 Upper end
40 Conduit
41 Section
42 Heat exchanger

The invention claimed is:

1. A Rankine cycle plant for the regasification of liquefied gas, comprising:

a Rankine closed loop system comprising at least:
one evaporator;
an expansion turbine provided with an inflow opening, an outflow opening and at least one auxiliary outlet;
a generator operatively connected to the expansion turbine;
a condenser;
a pump;
conduits configured to connect the evaporator, the expansion turbine, the condenser and the pump according to a closed cycle in which a working fluid circulates;

a source of liquefied gas at a cryogenic temperature, wherein the source of liquefied gas is operatively coupled to the condenser to receive heat from the working fluid flowing out from the expansion turbine so as to take the liquefied gas to the gaseous state;

a source of a heating fluid at a higher temperature than the cryogenic temperature, wherein the source of heating fluid is operatively coupled to the evaporator to transfer heat to the working fluid coming from the condenser;

wherein the expansion turbine is a radial centrifugal turbine, wherein said at least one auxiliary outlet is interposed between successive stages of said expansion turbine, and wherein the condenser is a multilevel condenser and comprises at least two condensing chambers, a lower chamber of said at least two condensing chambers is connected to the outflow opening and an upper chamber of said at least two condensing chambers is connected to said at least one auxiliary outlet, and wherein the expansion turbine comprises a single rotor disc and a plurality of stages radially arranged one after the other at a front face of the rotor disc, and wherein the auxiliary outlet opens between two of said stages.

2. The plant according to claim 1, wherein the expansion turbine comprises a plurality of auxiliary outlets each interposed between successive stages.

3. The plant according to claim 1, wherein the multilevel condenser comprises a casing delimiting therein said at least two condensing chambers and an outflow duct connecting the upper chamber to the lower chamber.

4. The plant according to claim 3, wherein the multilevel condenser comprises a plurality of condensing chambers arranged one over the other and a plurality of ducts connecting said condensing chambers to each other in a cascade fashion.

5. The plant according to claim 1, wherein the condenser has a series of inner septa that partition it internally in said condensing chambers.

6. The plant according to claim 3, wherein the casing of the condenser has an elongated shape and mainly a vertical extension.

7. The plant according to claim 4, wherein rising upwards with respect to the condenser, successive chambers are connected to auxiliary outlets of the expansion turbine at increasing pressure.

8. The plant according to claim 1, wherein the condenser comprises at least one tube or tube bundle connected to the source of liquefied gas; wherein said at least one tube or tube bundle passes through said at least two condensing chambers; wherein the liquefied gas flows from the bottom upwards through said at least one tube or tube bundle.

9. The plant according to claim 1, wherein the pump is only one and it is operatively arranged between the lower chamber of the condenser and the evaporator for pumping the condensed working fluid up to said evaporator.

10. The plant according to claim 1, wherein the conduits comprise a conduit connecting the lower chamber of the condenser and the evaporator, wherein a section of said conduit passes through at least one chamber of the condenser.

11. The plant according to claim 1, comprising a first and a second expansion turbine, wherein an outflow opening of the first expansion turbine is connected to an inflow opening of the second expansion turbine, wherein the first and/or the second expansion turbine has at least one auxiliary outlet.

12. The plant according to claim 11, comprising a heat exchanger located between the outflow opening of the first expansion turbine and the inflow opening of the second expansion turbine and operatively coupled to the source of heating fluid.

13. The plant according to claim 1, wherein the working fluid is selected from the group comprising: organic fluids, hydrocarbons, $CO_2$, $N_2O$.

14. The plant according to claim 1, wherein the heating fluid entering into the evaporator has a temperature ($T_{hf}$) comprised between 5° C. and 70° C.

15. The plant according to claim 1, wherein the heating fluid is seawater.

16. The plant according to claim 1, wherein the liquefied gas flowing into the condenser has a temperature ($T_{lg}$) comprised between −155° C. and −173° C.

17. A Rankine cycle plant for the regasification of liquefied gas, comprising:

a Rankine closed loop system comprising at least:
one evaporator;
a single expansion turbine provided with an inflow opening, an outflow opening and at least one auxiliary outlet;
a generator operatively connected to the expansion turbine;
a condenser;
a pump;
conduits configured to connect the evaporator, the expansion turbine, the condenser and the pump according to a closed cycle in which a working fluid circulates;

a source of liquefied gas at a cryogenic temperature, wherein the source of liquefied gas is operatively coupled to the condenser to receive heat from the working fluid flowing out from the expansion turbine so as to take the liquefied gas to the gaseous state;

a source of a heating fluid at a higher temperature than the cryogenic temperature, wherein the source of heating fluid is operatively coupled to the evaporator to transfer heat to the working fluid coming from the condenser;

wherein the expansion turbine is a radial centrifugal turbine, wherein said at least one auxiliary outlet is interposed between successive stages of said expansion turbine, and wherein the condenser is a multilevel condenser and comprises at least two condensing chambers, wherein a lower chamber of said at least two condensing chambers is connected to the outflow opening and an upper chamber of said at least two condensing chambers is connected to said at least one auxiliary outlet.

18. The plant according to claim 17, wherein the expansion turbine comprises a single rotor disc and a plurality of stages radially arranged one after the other at a front face of the rotor disc, and wherein the auxiliary outlet opens between two of said stages.

19. The plant according to claim 18, wherein the two stages between which the auxiliary outlet opens, are radially spaced to define a chamber for extracting the working fluid.

20. The plant according to claim 18, wherein the expansion turbine comprises a fixed housing, wherein the rotor disc is rotatably inserted into the fixed housing, wherein the auxiliary outlet is obtained in a front wall of the fixed housing.

* * * * *